US007631441B2

(12) United States Patent
Hunt

(10) Patent No.: US 7,631,441 B2
(45) Date of Patent: Dec. 15, 2009

(54) WEARING EDGE ATTACHMENT SYSTEM

(75) Inventor: Brad Hunt, Petersburg (CA)

(73) Assignee: Valley Blades Limited, Waterloo, Ontario (CA)

( * ) Notice: Subject to any disclaimer, the term of this patent is extended or adjusted under 35 U.S.C. 154(b) by 0 days.

(21) Appl. No.: 12/073,740

(22) Filed: Mar. 10, 2008

(65) Prior Publication Data

US 2009/0223090 A1 Sep. 10, 2009

(51) Int. Cl.
*E01H 5/04* (2006.01)

(52) U.S. Cl. ..... 37/232; 37/266

(58) Field of Classification Search ..... 37/446, 37/457, 449, 447, 455, 456, 458, 231–233, 37/266–268; 172/772.5, 811, 817, 261, 264
See application file for complete search history.

(56) References Cited

U.S. PATENT DOCUMENTS

| | | | | |
|---|---|---|---|---|
| 2,061,585 | A * | 11/1936 | Meyer | 37/233 |
| 4,669,205 | A | 6/1987 | Smathers | |
| 5,743,032 | A * | 4/1998 | Vauhkonen | 37/446 |
| 5,746,017 | A | 5/1998 | Marvik | |
| 5,778,572 | A * | 7/1998 | Lukavich et al. | 37/460 |
| 5,813,474 | A * | 9/1998 | Manway | 172/701.3 |
| 6,817,118 | B2 * | 11/2004 | Schmeichel | 37/232 |
| 6,854,527 | B2 | 2/2005 | Manway et al. | |
| 6,922,924 | B2 * | 8/2005 | Jones et al. | 37/449 |
| 7,107,709 | B2 | 9/2006 | Hamel | |
| 2004/0231201 | A1 | 11/2004 | Hamel | |
| 2006/0070264 | A1 | 4/2006 | Lachance et al. | |

* cited by examiner

*Primary Examiner*—Robert E Pezzuto
(74) *Attorney, Agent, or Firm*—Pillsbury Winthrop Shaw Pittman LLP

(57) ABSTRACT

A wearing edge attachment system including a mounting assembly having a first portion adapted to engage a support on a vehicle, and a second portion. The wearing edge attachment system further includes at least one wearing edge, a flexible device adapted to surround and engage a portion the wearing edge and a fastening device. The fastening device secures the flexible device and the wearing edge to the second portion of the mounting assembly.

20 Claims, 12 Drawing Sheets

WEARING EDGE ATTACHMENT SYSTEM

FIELD OF THE INVENTION

This invention relates in general to blade arrangements for snow removal and the like and more particularly to a removable wearing edge attachment system that may be attached to a snow plough.

BACKGROUND OF THE INVENTION

Blade arrangements or systems for snow removal are typically mounted directly to a vehicle so as to remove snow and ice from a wide variety of road surfaces. Depending on the environmental conditions, the type of road surface and the user ability that the snow plough blade arrangement is exposed to, the wear on the snow plough blade can be extensive and costly as the operator is constantly replacing the blades. Typical challenges for the blades include uneven road surface resulting in uneven/premature wear, repeated impact to the blades, hitting obstacles on the road, and operator error.

Prior art blade systems have been devised to address some of the noted problems. For example, U.S. Pat. No. 5,746,017 issued May 5, 1998 to Jostein discloses a ploughshare having cutting edges and a securing device for attachment to a plough. The plough share has a number of individual metallic shares which are firmly permanently embedded in an elastomer mass. During use, each individual share is independently moveable from the underlying surface against the elasticity in the mass with a view of absorbing or adjusting itself to irregularities in the underlying surface. The share is mounted substantially vertical and is especially designed for equipment for clearing snow.

U.S. Pat. No. 4,669,205 issued on Jan. 24, 1986 to Smathers and relates to a snow plow apparatus is described having segmented blade means comprising a plurality of bits. Each bit is connected to a vertically disposed shank having a triangular cross-section. The shank is slidably mounted in triangularly-shaped retention means carried by the plow moldboard. Bias means urges the shank and bit to its normal downward position. Each bit is independently mounted so that it can be vertically displaced when it encounters a high point in the roadway or an obstruction. The bias means urges the bit downwardly again when the obstruction is cleared.

U.S. Pat. No. 5,743,032 which issued on Apr. 28, 1998 to Vauhkonen relates to a plough blade arrangement for a snowplough. The plough blade arrangement includes a frame consisting of a flat part removably attached to the plough, several blade plates covering the desired working width, and attachment members for the blade plates to the frame. The aforesaid attachment members consist of flexible members, which are arranged to permit the movement of the blade plates essentially in only one direction in the direction of the surface of the frame when the blade plate strikes an obstacle or pit.

U.S. Pat. No. 2004/0231201 issued on Nov. 25, 2004 to Hamel relates to an articulated scraper blade system mounted to a snow plow blade length installed in the front of a vehicle for snow scraping, which comprises a multitude of carbide sections moving independently when they strike an obstacle on a road surface.

The prior art however does not address the reduction of wear on snow blade systems as a result of the blades having metal to metal contact at different points in the attachment system. Furthermore prior art systems do not completely address the ability to accommodate uneven and different road surfaces. Finally the easy replacement of blades and the ecologically safe disposal of the blades and flexible elements are also not adequately addressed.

Thus a wearing edge attachment system that is easy to attach and detach, can be disposed of in an ecological approved manner, contours to uneven road surface, cleans the road more, completely eliminates metal to metal contact and therefore wear by isolating the wearing edge is desirable.

SUMMARY OF THE INVENTION

An object of one aspect of the present invention is to provide an improved wearing edge attachment system.

In accordance with one aspect of the present invention there is provided a wearing edge attachment system including a mounting assembly having a first portion adapted to engage a support on a vehicle, and a second portion. The wearing edge attachment system further includes at least one wearing edge, a flexible means adapted to surround and engage a portion of the wearing edge and a fastening means. The fastening means secures the flexible means and the wearing edge to the second portion of the mounting assembly.

Conveniently, the first portion of the mounting assembly is a mounting bar having attachment zones for securing the mounting bar to the support on the vehicle and the second portion of the mounting assembly is a holder member adapted to receive the wearing edge and the flexible means.

Preferably, the wearing edge includes a profile having a first portion adapted to receive the flexible means, and further includes stop zones adapted to engage the flexible means and limit the movement of the wearing edge attachment system, as well as a second portion adapted to engage a surface.

Conveniently the flexible means includes an upper flexible element, at least one face flexible element and at least one fastener flexible element. Both the upper flexible element and the face flexible element are adapted to engage the first portion of the profile so as enclose the first portion and isolate the profile from metal on metal contact.

Conveniently the wearing edge attachment system may be adapted to be mounted to a nosepiece that may be attached to the one end of the support on the vehicle. The nosepiece allows for the continuance of the wearing edge attachment system around a corner thereby directing the snow back in front of the vehicle.

Advantages of the present invention are the ability to isolate the wearing edge in a flexible means so as eliminate any metal on metal contact within the system, the ability to adapt to a wide variety of road surfaces while maintaining contact with the road surface, may be used with different types of edges so as accommodate different applications, design reduces the possibility of catastrophic failure as exhibited with excessive wear, easy installation and replacement, ecologically safe disposal of worn edges and flexible elements, customized motion control along independent vectors, does not require any modification to the vehicle it is mounted on and does not change the traditional operating parameters namely height of the snow plough.

BRIEF DESCRIPTION OF THE DRAWINGS

A detailed description of the preferred embodiments is provided herein below by way of example only and with reference to the following drawings, in which.

Figure 1:
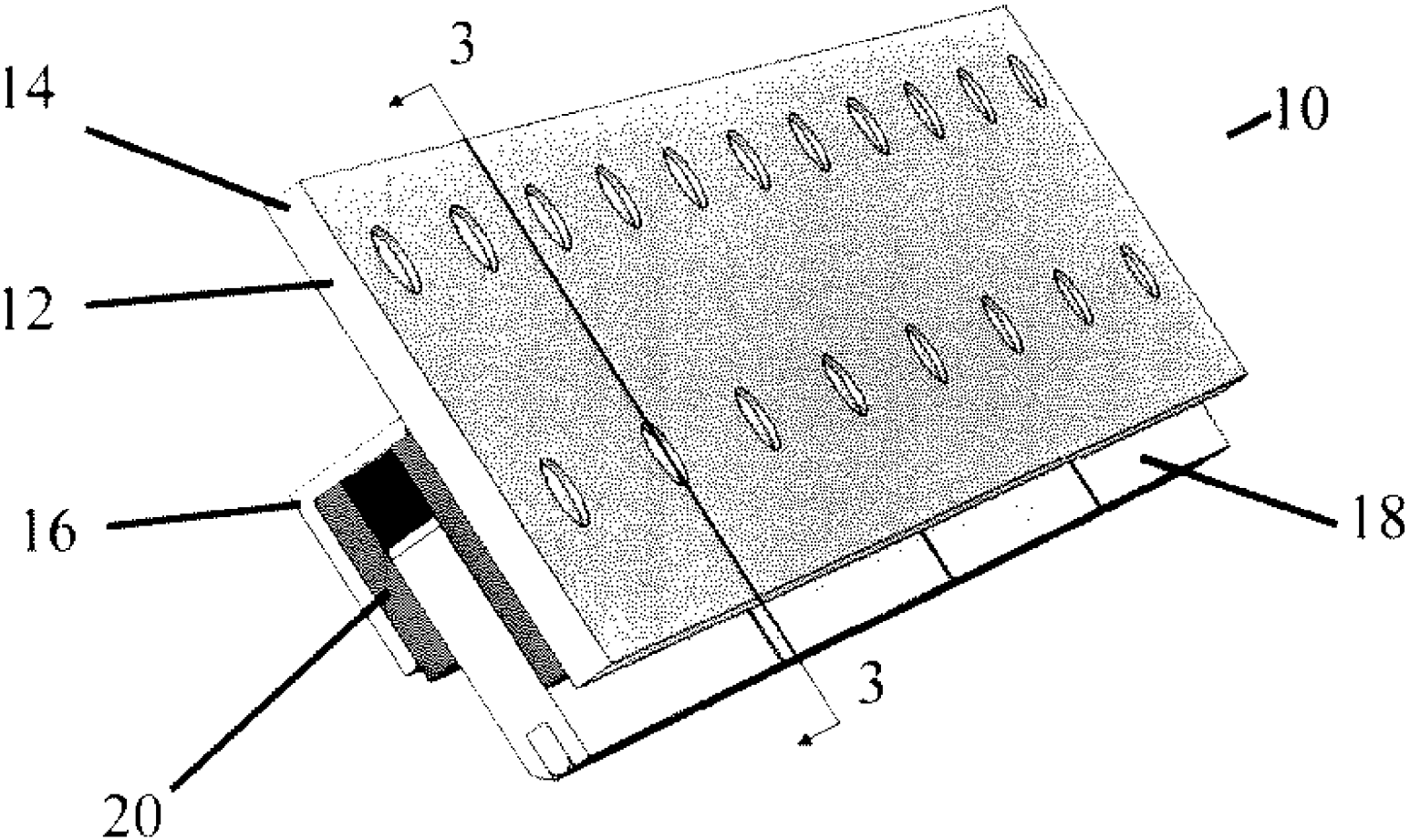
FIG. 1 in a perspective view, illustrates a wearing edge attachment system in accordance with a preferred embodiment of the present invention.
Figure 2:
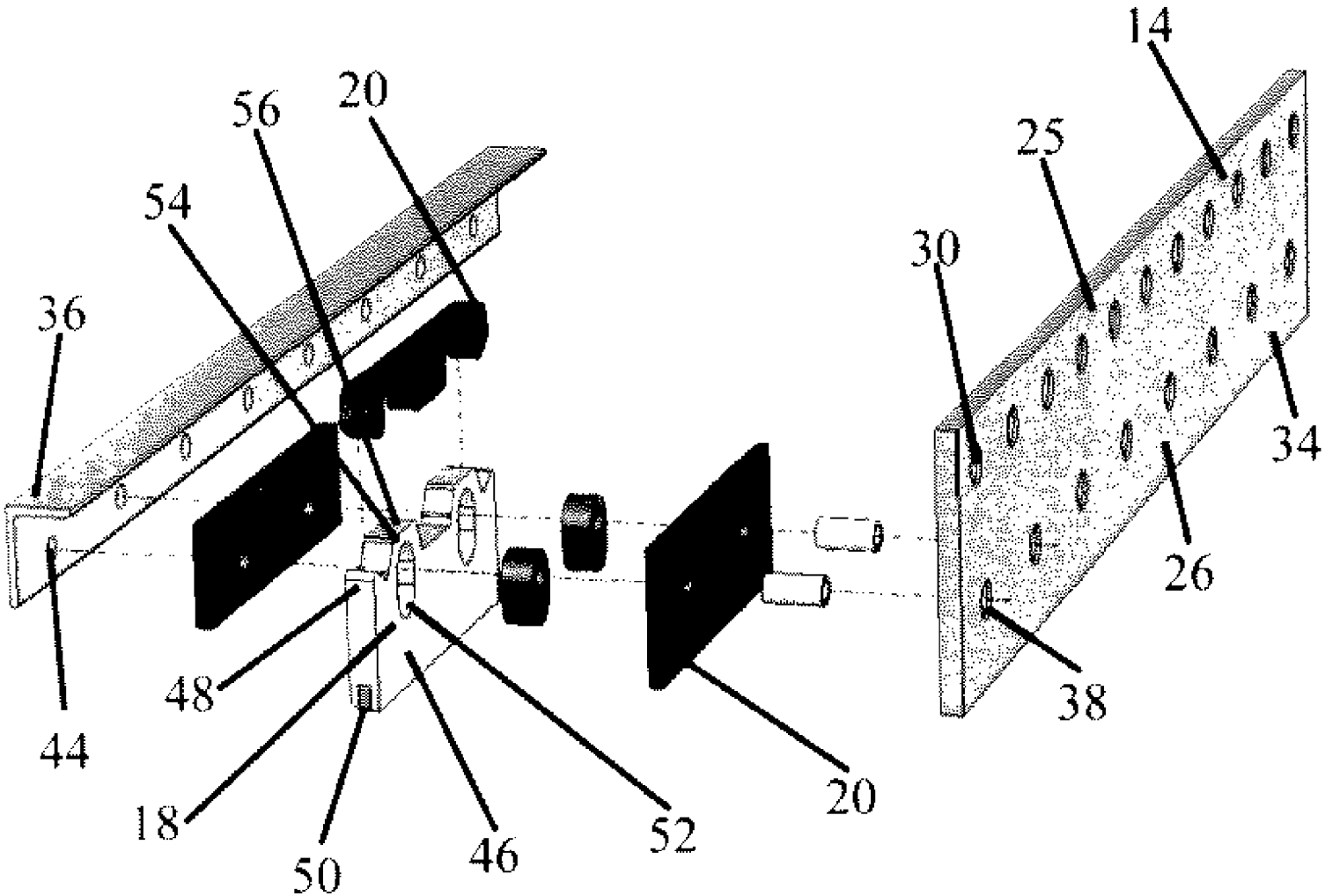
FIG. 2 in an exploded view, illustrates the wearing edge attachment system of FIG. 1.
Figure 3:
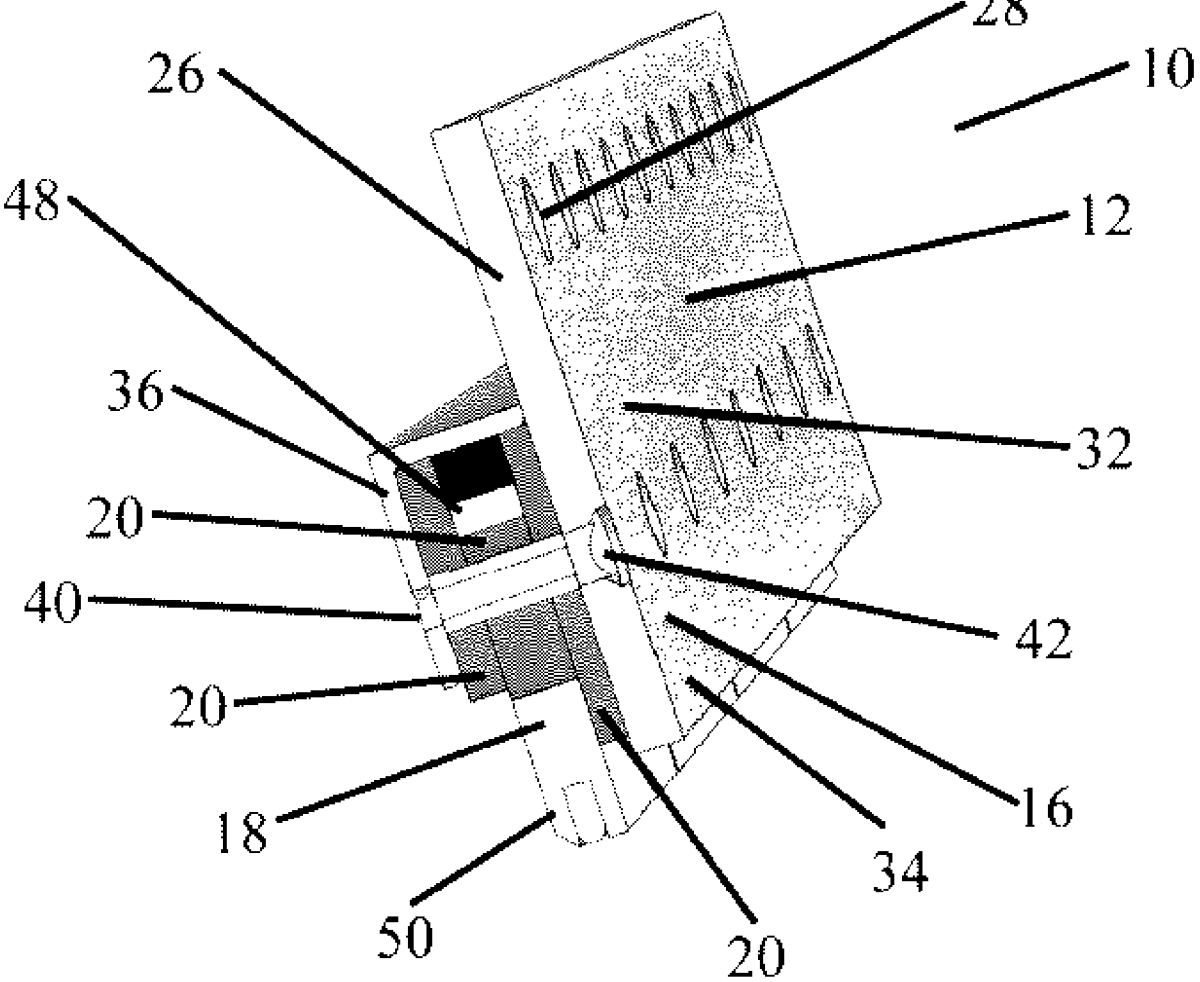
FIG. 3 in a cross section view, illustrates the wearing edge attachment system of FIG. 1.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Referring to FIGS. 1 to 4, there are illustrated a wearing edge attachment system 10 in accordance with a preferred embodiment of the present invention. The wearing edge attachment system 10 includes a mounting assembly 12 having a first portion 14 adapted to engage a support on a vehicle (not shown), and a second portion 16. The wearing edge attachment system 10 further includes at least one wearing edge 18, a flexible means 20 adapted to surround and engage a portion 22 of the wearing edge and a fastening means 24. The fastening means 24 secures the flexible means 20 and the wearing edge 18 to the second portion 16 of the mounting assembly 12.

More specifically the first portion 14 of the mounting assembly 12 may be the top portion 25 of a mounting bar 26 having attachment zones 28 for securing the mounting bar 26 to the support on the vehicle (not shown). The mounting bar 26 may be further defined as the top portion of a steel bar by way of example only. The attachment zones 28 may be further defined as square counter sunk holes 30 that are arranged across the top portion 25 of the mounting bar 26 and are adapted to accept plough bolts for the attachment of the mounting bar 26 to the support on the vehicle such as a snow plough.

The second portion 16 of the mounting assembly 12 may be further defined as a holder member 32 which is adapted to receive the wearing edge 18 and the flexible means 20. The holder member 32 may be further defined as the bottom portion 34 of the mounting bar 26 and includes a backer angle 36 that allows for the holding and positioning of the flexible means 20 and the wearing edge 1 8. Both the bottom portion 34 of the mounting bar 26 and the backer angle 36 include a series of attachment zones 38 and 40 respectively for receiving the fastening means 24. The series of attachment zones 38 and 40 include a first series of square counter sunk holes 42 on the bottom portion 34 of the mounting bar 26 and a second series of round holes 44 on the backer angle 36 which are co-axial to the first series 42.

The wearing edge 18 includes a profile 46 having a first portion 48 adapted to receive the flexible means 20 and a second portion 50 adapted to engage a surface (not shown). The profile 46 further includes a series of apertures 52 which are adapted to receive the fastening means 20. The first portion 48 of the profile 46 further includes a series of stop zones 54 which are designed and adapted to engage the flexible means 20 thereby limiting the movement of the wearing edge attachment system 10. The stop zones 54 may be defined as flat areas 56 which engage the flexible means 20 and limit the travel of the wearing edge attachment system 10 so as not to exceed the allowable deformation of the flexible means 20.

The profile 46 may be made from a variety of materials depending on the application of the wearing edge attachment system 10. For example the profile may be made from steel, carbide, or ceramic. Furthermore the profile 46 is further defined as sections of the desired material have a unique shape. Typically the profile 46 is a maximum of twenty-four inches in length. The unique shape of the profile 46 allows for the maximum distance of vertical travel by wearing edge attachment system 10 but does not overly increase the operating height of the wearing edge attachment system 10, namely the distance from the surface to the support on the vehicle.

Figure 4:
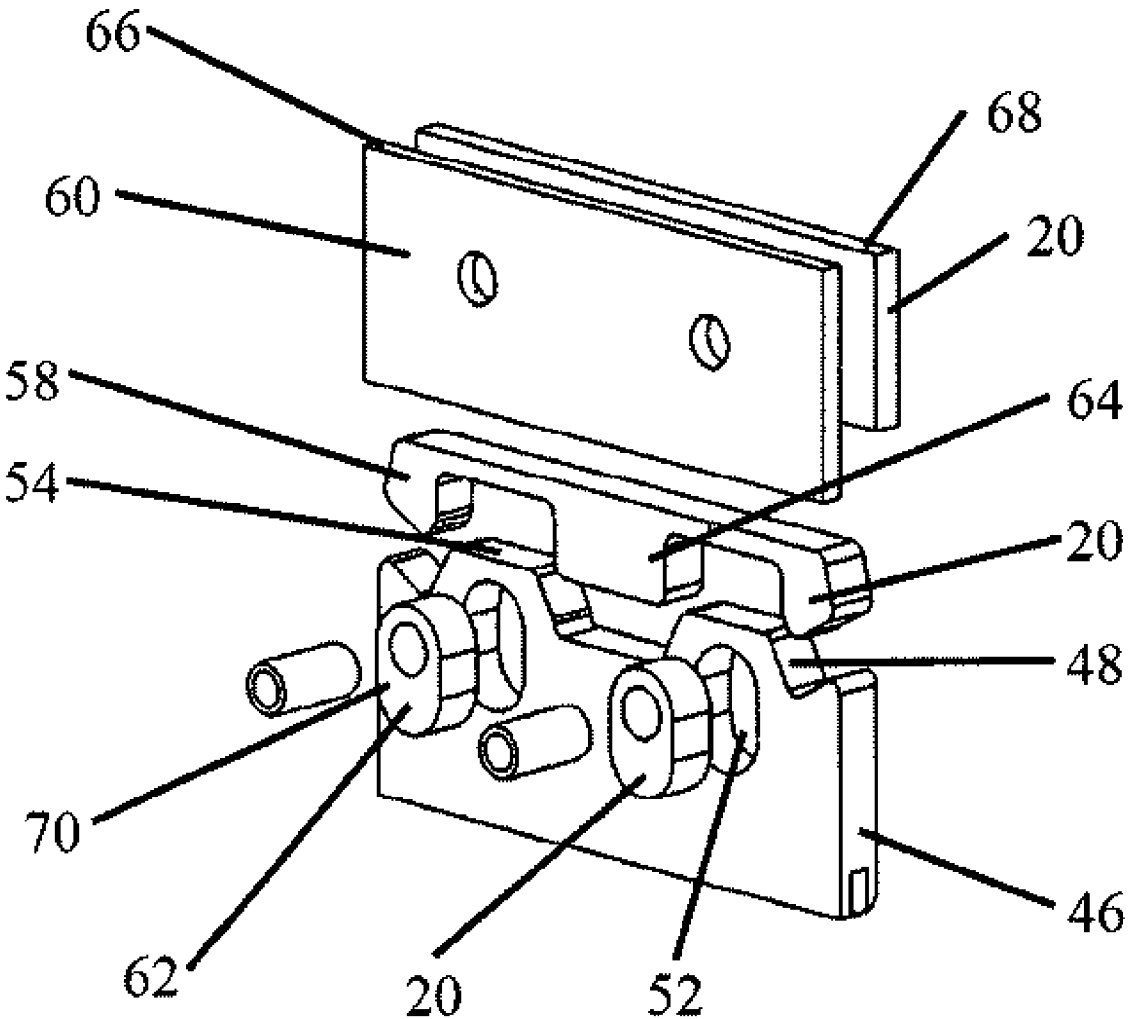
FIG. 4 in an exploded view, illustrates the wearing edge attachment system of FIG. 1.

Referring to FIG. 4 the flexible means 20 may be defined as an upper flexible element 58, at least one face flexible element 60 and at least one fastener flexible element 62. Both the upper flexible element 58 and the face flexible element 60 are adapted to engage the first portion 48 of the profile 46 so as enclose the first portion 48 and isolate the profile 46. The upper flexible element 60 may be further defined as a series of elastomeric springs 64 that are adapted to engage the first portion 48 of the profile 46 namely the stop zones 54 thereby controlling the vertical movement of the wearing edge attachment 10. The upper flexible element 60 may be made from an elastomeric material with varying durometer of stiffness to aid in the ability to control the vertical movement of the wearing edge 18.

The face flexible element 60 may be further defined as a front flexible element 66 and a back flexible element 68, both of which engage the profile 46 so as to isolate wearing edge 18 from the mounting assembly 12. The fastener flexible element 70 is adapted to be inserted into the series of apertures 52 on the profile 46. Upon the insertion of the fastener flexible element 70 into the apertures 52, the fastening means 24 may therefore pass through the entire profile 46 in complete isolation resulting in no metal on metal contact. Furthermore the fastener flexible element 70 helps to control the vertical movement of the profile 46 when the wearing edge attachment system 10 is in operation.

The upper flexible element 58, the face flexible element 60 and the fastener flexible element 62 may all be made from an elastomeric material having varying durometers. Depending on the location of each flexible element, a different elasticity may be required for the flexible element to function in the appropriate manner.

Figure 5:
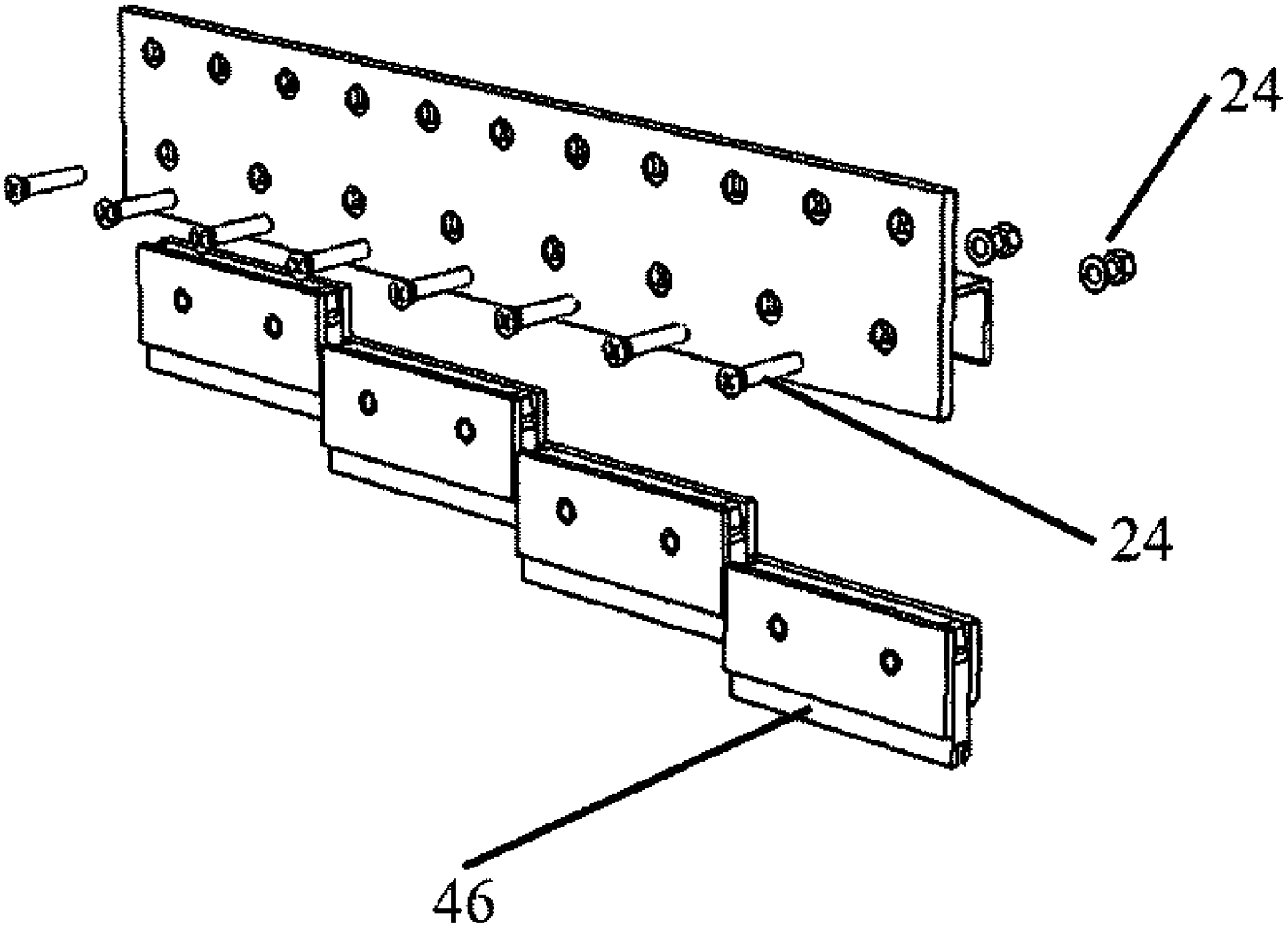
FIG. 5 in an exploded view, illustrates the wearing edge attachment system of FIG. 1.
Figure 6C:
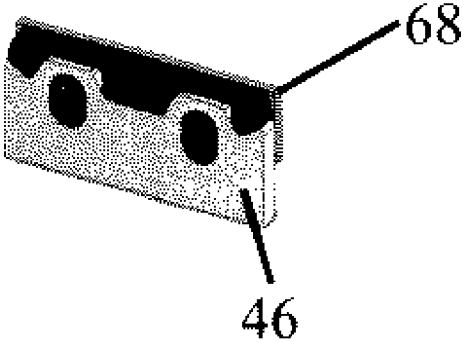
FIG. 6*c* in a perspective view, illustrates the addition of the flexible means to the profile of the wearing edge attachment system of FIG. 1.
Figure 6D:
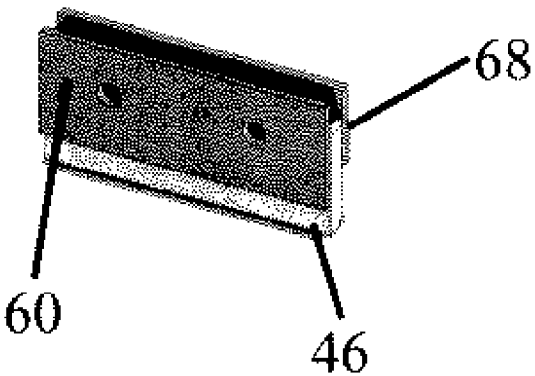
FIG. 6*d* in a perspective view, illustrates the addition of the flexible means to the profile of the wearing edge attachment system of FIG. 1.
Figure 6A:
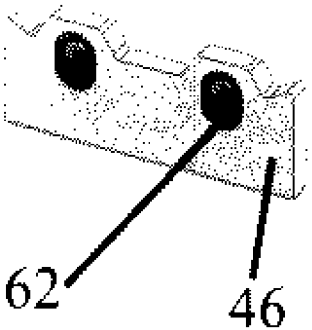
FIG. 6*a* in a perspective view, illustrates the profile of the wearing edge attachment system of FIG. 1.
Figure 6B:
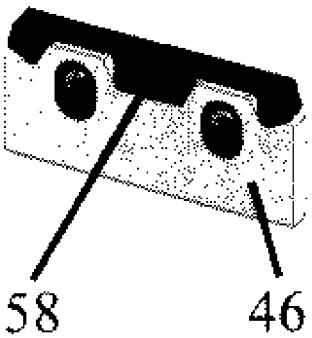
FIG. 6*b* in a perspective view, illustrates the addition of the flexible means to the profile of the wearing edge attachment system of FIG. 1.
Figure 7C:
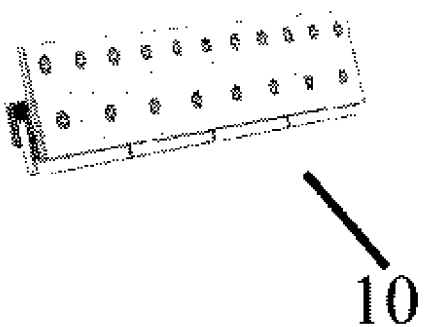
FIG. 7*c* in a perspective view, illustrates multiple wearing edge attachment systems of FIG. 1.
Figure 7A:
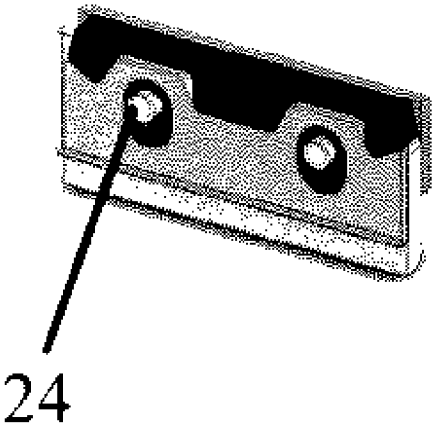
FIG. 7*a* in a perspective view, illustrates the addition of the flexible means to the profile of the wearing edge attachment system of FIG. 1.
Figure 7B:
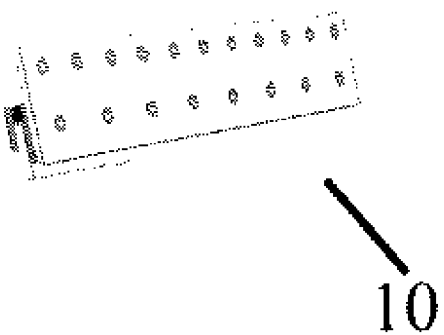
FIG. 7*b* in a perspective view, illustrates the mounting of a single wearing edge attachment system of the wearing edge attachment system of FIG. 1.
Figure 8:
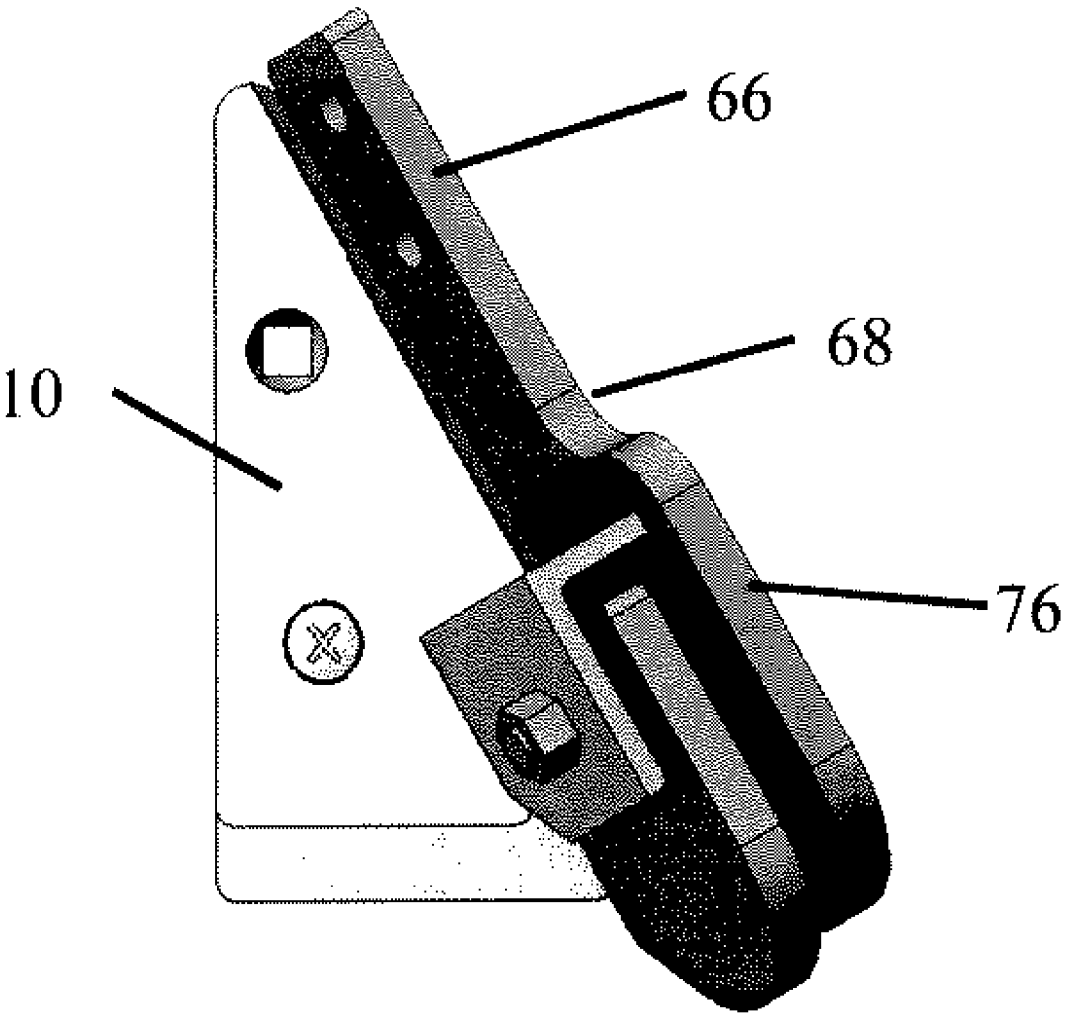
FIG. 8 in a perspective view, illustrates the wearing edge attachment system of FIG. 1 mounted as a nosepiece.
Figure 9:
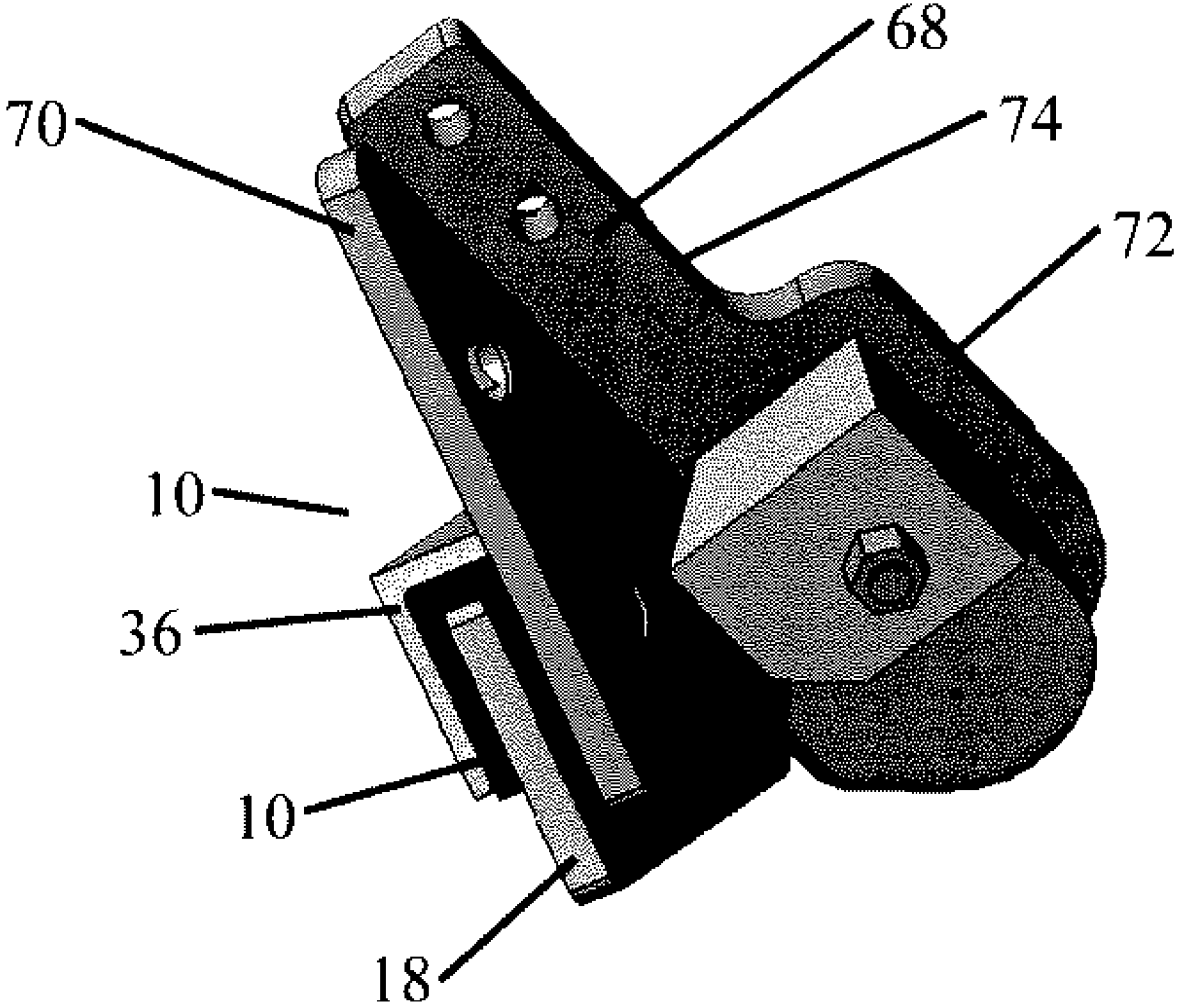
FIG. 9 in a perspective view, illustrates the wearing edge attachment system of FIG. 1 mounted as a nosepiece.
Figure 10:
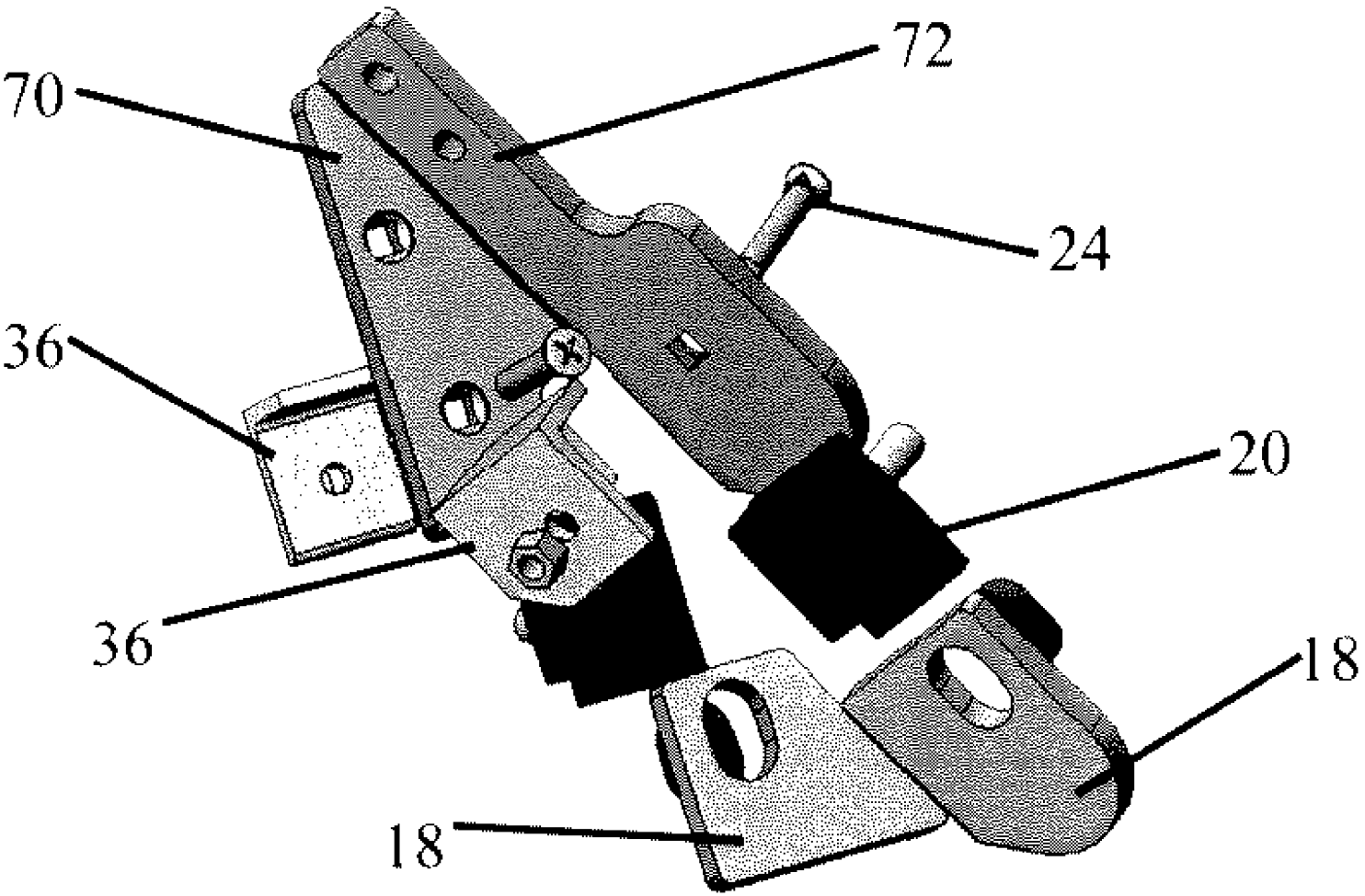
FIG. 10 in an exploded view, illustrates the wearing edge attachment system of FIG. 8.
Figure 11A:
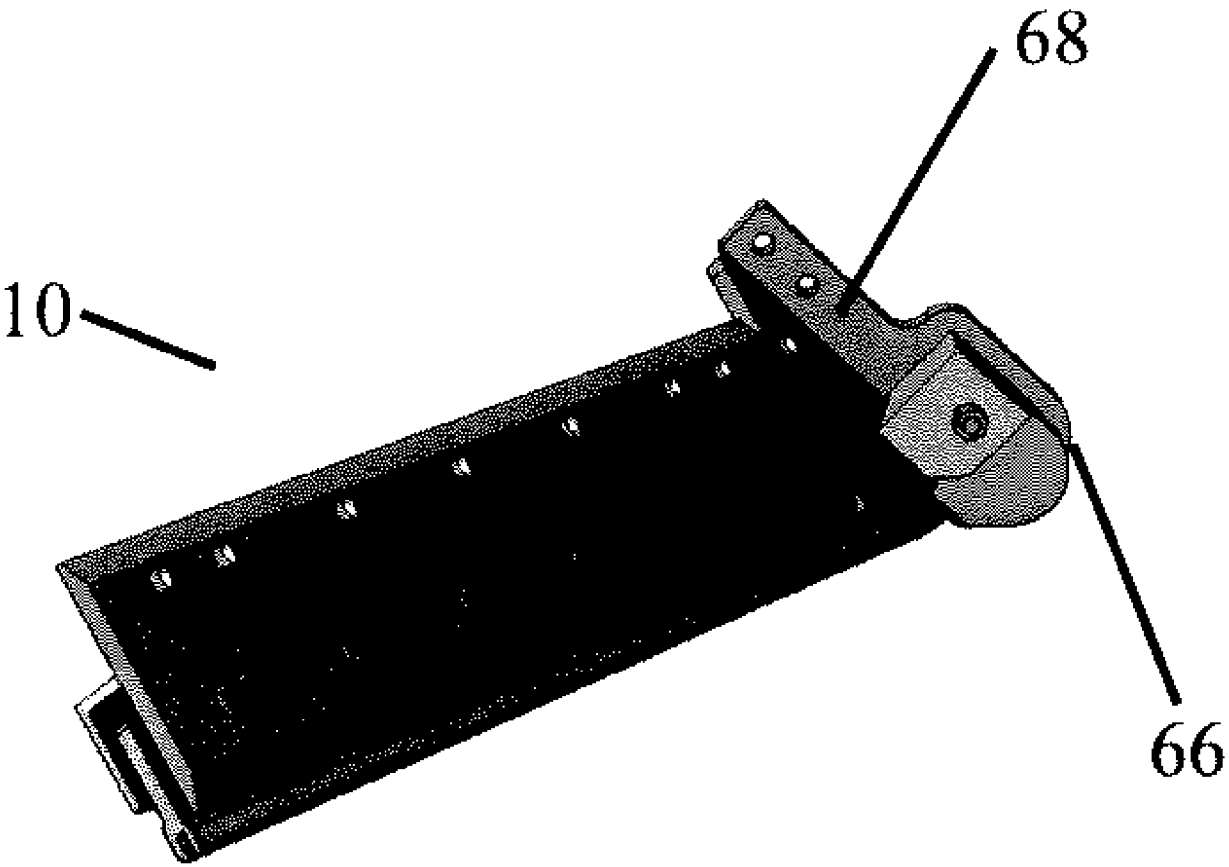
FIGS. 11*a* and 11*b* in perspective views, illustrate the wearing edge attachment system of FIG. 7*c* with a nosepiece.
Figure 11B:
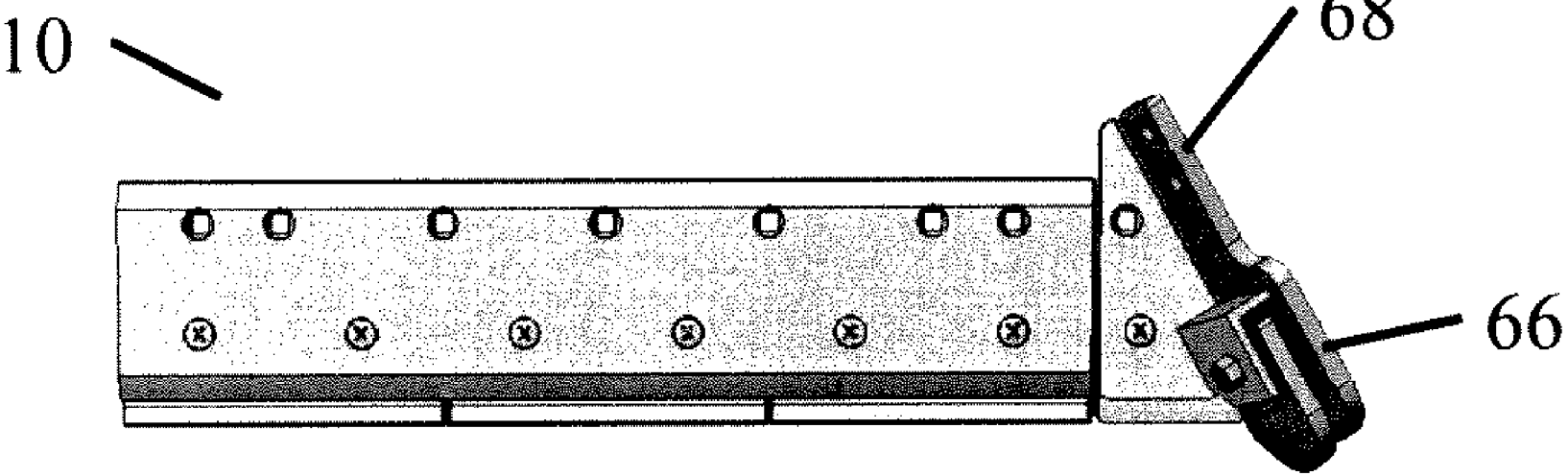

Referring to FIG. 5 the fastening means 24 may include a number of different attach mechanisms such as a combination of bolt, washer and nut and bolt bushings. The fastening means 24 therefore attaches the wearing edge attachment system 10 to the support member of the vehicle without having any metal on metal contact while passing through the profile 46.

The ability to have absolutely no metal on metal contact significantly reduces the vibration throughout the whole system and results in more complete and efficient snow removal by way of example only, as well as reducing overall operating costs. Upon the installation of the wearing edge attachment system 10, the operation of the system 10 is as follows. The instant invention utilizes the weight of the snow plough from above and the normal forces from below to preload the system 10 with compressive forces. As such the compressive forces are directly transmitted to the upper flexible element 60 and more specifically to the series of elastomeric springs 64 as well as the fastener flexible element 62. As the vehicle and the wearing edge attachment system 10 moves over uneven surfaces, specifically a higher than normal spot, the individual wearing edges 18 can move upward independently of one another and further compress the upper flexible element 60 and the fastener flexible element 62. As the vehicle moves along the surface having a lower than normal height, the wearing edge 18 can move down reducing the preload of compressive forces.

Furthermore the system 10 can accommodate or control movement along all vectors independently of one another (back to front, up and down, right to left) therefore providing for more efficient movement of the system 10. Finally the system allows for the total isolation of the wearing edge 18 as it is encompassed in the various flexible means 20 save for the actual edge in contact with the surface, therefore allowing for complete conformity of the snow ploughing edge to an uneven road surface. The use of multiple wearing edge attachment systems 10 that can act independently of one another and easily conform to an uneven road surface, also contributes to the significant reduction of catastrophic failures of the system 10 as individual wearing edges 18 fail can be easily replaced.

FIGS. 6*a* to 7*c* illustrate the assembly of the wearing edge attachment system 10. The wearing edge attachment system 10 when installed includes multiple wearing edges 18 mounted along the mounting assembly 12 and then to the support of the vehicle to provide a length of wearing edge efficient for snow ploughing by way of example only. Due to the design and assembly each of the wearing edge attachment systems 10 are removable, thereby allowing for the easy replacement of worn parts such as the wearing edge 18 itself. Furthermore the instant invention allows for the ecologically safe disposal of the various elements, namely the wearing edge 18, the fastening means 24 and the flexible means 20 by way of example only.

Referring to FIGS. 8 to 11*b*, there is illustrated the wearing edge attachment system 10 adapted to be mounted to a nosepiece 66. More specifically the nosepiece 66 may include a bracket system 68 that is mounted to the support on the vehicle. The bracket system 68 may include a first portion 70 and a second portion 72 mounted at right angles to one another. The first portion 70 has a similar structure to that described above with respect to the backer angle 36 that allows for the holding and positioning of the flexible means 20 and the wearing edge 18. The second portion 72 may defined as having a front face 74 and a back face 76. The front face 74 has mounted to it a similar structure that is described above namely the backer angle 36. The remaining elements, specifically the flexible means 20, the wearing edge 19 and fastening means 24 are then positioned identically in the backer angle 36. The resulting configuration allows for the wearing edge 18 to be positioned down the length of the support on the vehicle and then extend out at right angles from the support so as provide for the nosepiece 66. With this configuration the wearing edge attachment system 10 allows for the superior engagement of the surface regardless of its evenness and therefore results in more effective snow removal.

Other variations and modifications of the invention are possible. All such modifications or variations are believed to be within the spirit and scope of the invention as defined by the claims appended hereto.

I claim:

1. A wearing edge attachment system comprising:

(a) a mounting assembly having a first portion configured to engage a support on a vehicle, and a second portion;

(b) a rigid wearing edge having a first, top portion and a second, bottom portion, the second, bottom portion configured to engage and scrape a ground surface;

(c) a flexible absorber configured to surround and engage only the first, top portion of the wearing edge and to absorb at least a portion of the movement of the second, bottom portion of the wearing edge when the second, bottom portion of the wearing edge is engaging the ground surface; and (d) a fastening means for fastening the top portion of the wearing edge and the flexible absorber to the second portion of the mounting assembly.

2. The wearing edge attachment system according to claim 1, wherein the first portion of the mounting assembly is a mounting bar having attachment zones for securing the mounting bar to the support on the vehicle.

3. The wearing edge attachment system according to claim 2, wherein the attachment zones are square counter sunk holes.

4. The wearing edge attachment system according to claim 1, wherein the second portion of the mounting assembly is a holder member configured to receive only the first, top portion of the wearing edge and the flexible absorber.

5. The wearing edge attachment system according to in claim 4, wherein the holder member comprises a series of attachment zones for receiving the fastening means.

6. The wearing edge attachment system according to claim 5, wherein the series of attachment zones comprise a first series of square counter sunk holes and a second series of round holes co-axial to the first series.

7. The wearing edge attachment system according to claim 6, wherein the wearing edge comprises a profile having a first portion with a series of apertures configured to first receive the flexible absorber within the apertures and the fastening means and a second portion configured to engage the ground surface.

8. The wearing edge attachment system according to claim 7, wherein the profile is made from steel, carbide, or ceramic.

9. The wearing edge attachment system according to claim 7, wherein the wearing edge is a maximum of twenty-four inches in length.

10. The wearing edge attachment system according to claim 7, wherein the first portion of the profile further includes stop zones configured to engage the flexible absorber and limit the movement of the wearing edge attachment system.

11. The wearing edge attachment system according to claim 7, wherein the flexible absorber comprises an upper flexible element, at least one face flexible element and at least one fastener flexible element.

12. The wearing edge attachment system according to claim 11, wherein the upper flexible element and the face flexible element are configured to engage the first portion of the profile so as enclose the first portion and isolate the profile.

13. The wearing edge attachment system according to claim 12, wherein the upper flexible element further comprises a series of elastomeric springs configured to engage the first portion of the profile for movement control of the wearing edge attachment.

14. The wearing edge attachment system according to claim 11, wherein the fastener flexible element is configured to be inserted into the series of apertures.

15. The wearing edge attachment system according to claim 11, wherein the upper flexible element, the face flexible element and fastener flexible element are made from elastomeric material having varying durometers.

16. The wearing edge attachment system according to claim 1, wherein the fastening means comprises a combination of a bolt, a washer and a nut.

17. The wearing edge attachment system according to claim 16, wherein the fastening means further comprises bolt bushings.

18. The wearing edge attachment system according to claim 1, wherein the wearing edge attachment system comprises multiple wearing edges mounted to the support of the vehicle to provide a length of wearing edge.

19. The wearing edge attachment system according to claim 1, wherein the wearing edge attachment system is configured to a nosepiece.

20. A wearing edge attachment system comprising:

(a) a mounting assembly having a first portion configured to engage a support on a vehicle, and a second portion;

(b) a rigid wearing edge having a first, top portion and a second, bottom portion, the second, bottom portion configured to engage and scrape a ground surface;

(c) a flexible absorber configured to surround and engage only the first, top portion of the wearing edge and to absorb at least a portion of the movement of the second, bottom portion of the wearing edge when the second, bottom portion of the wearing edge is engaging the ground surface; and (d) a fastener configured to fasten the top portion of the wearing edge and the flexible absorber to the second portion of the mounting assembly.

* * * * *